United States Patent [19]

Taura et al.

[11] Patent Number: 5,066,184

[45] Date of Patent: Nov. 19, 1991

[54] METHOD FOR SEAMING PACKED CANS

[75] Inventors: Yoshiharu Taura, Takasago; Yoshinori Yuzaki, Hiroshima; Koichi Takagi, Nagoya, all of Japan

[73] Assignee: Mitsubishi Jukogyo Kabushiki Kaisha, Tokyo, Japan

[21] Appl. No.: 616,804

[22] Filed: Nov. 19, 1990

Related U.S. Application Data

[63] Continuation of Ser. No. 297,937, Jan. 17, 1989, abandoned.

[51] Int. Cl.[5] ..... B21D 51/32

[52] U.S. Cl. ..... 413/4; 413/6

[58] Field of Search ..... 413/4, 5, 6, 7, 31, 413/34, 36

[56] References Cited

U.S. PATENT DOCUMENTS 1,574,764 3/1926 Tevander ..... 413/6
1,827,545 10/1931 Schroeder .
2,725,000 11/1955 O'Neil ..... 413/6
2,943,386 7/1960 Katz ..... 413/4
4,578,007 3/1986 Diekoff .

FOREIGN PATENT DOCUMENTS 13927 of 1887 Fed. Rep. of Germany ..... 413/31
1065358 3/1960 Fed. Rep. of Germany .
2064468 6/1981 United Kingdom .

*Primary Examiner*—James G. Smith
*Assistant Examiner*—Jack Lavinder
*Attorney, Agent, or Firm*—Wenderoth, Lind & Ponack

[57] ABSTRACT

A packed can is seamed by clamping a can body and a lid between a lifter and a chuck, rotationally driving the entire assembly while applying a compression force thereto, and pressing a groove portion of a roll from the outside to an edge portion of the lid to deform such edge portion. Seaming is effected by pressing the groove portion of the roll to the edge portion of the lid with the rotary axis of the roll maintained inclined with respect to the rotary axis of the chuck.

1 Claim, 4 Drawing Sheets

METHOD FOR SEAMING PACKED CANS

This application is a continuation of now abandoned application Ser. No. 07/297,937 filed on Jan. 17, 1989.

BACKGROUND OF THE INVENTION

1. Field of the Invention

The present invention relates to a method for seaming packed cans and which is applicable with a can seamer for seaming cans of aluminum, iron and the like packed or filled with beer, coffee, juice or the like.

2. Description of the Prior Art

An automatic can seamer for packed cans in the prior art is disclosed in Laid-Open Japanese Utility Model Specification No. 60-171640 (1985). Explaining the operation of such device with reference to FIG. 3, a can body 4 is placed on a lifter 3 having the same rotary axis 12 as a chuck 2 that is driven by a drive mechanism. After a lid 5 is placed on the can body 4 the lifter 3 is pushed up so that the lid 5 and the can body 4 are clamped between the chuck 2 and the lifter 3 and subjected to a compressing force. The lid 5, the can body 4 and the lifter 3 are integrally rotated by driving the chuck 2. Thereafter, a groove 6 of a roll 1 is pressed against an edge portion 5*a* of the lid 5 (FIG. 4) to deform downwardly and inwardly and then upwardly the edge portion 5*a*, as shown in FIG. 5. Thereby a flange edge 4*a* of the can body 4 also is deformed downwardly along with the aforementioned deformation of the lid edge portion 5*a*. Eventually seaming was effected to completion in such manner that a perfectly folded mouth edge defined by flange edge 4*a* of the can body 4 was pinched between the edge portion 5*a* and a seamed lid peripheral portion 5*b*, as shown in FIG. 6, and thereby attachment of the lid to the can body was achieved. In this prior art method, a rotary axis 11 of the roll 1 and the rotary axis 12 of the chuck 2 are parallel to each other, and the roll 1 moves from the outside in a direction perpendicular to the rotary axis 12 so that it will successively press the edge portion 5*a* of the lid 5.

In the above-described prior art device, a successive working process is employed, in which the roll 1 is brought close to the edge portion 5*a* of the lid 5 from the outside in the direction perpendicular to the roll rotary axis 11 and the chuck rotary axis 12 to press the edge portion 5*a*, and the edge portion 5*a* is deformed downwardly and inwardly and then upwardly. The larger is the overlap dimension h of the can (FIG. 6), the better is the sealing property between the can and the lid and the better is the appearance of the can. However, in order to enlarge this overlap dimension h, it is required that, when the lid 5 is placed on the can body 4 and when they are compressed by the lifter while clamped between the chuck 2 and the lifter 3, the seaming portion of the lid 5 on the side of the can body 4 should bend exactly at a base portion 7 thereof where the lid 5 and the can body 4 come into contact with each other, to ensure a sufficient "body hook" (fold length) dimension l.

However, in the above-mentioned prior art seaming device, since the structure of the roll 1 is such that it moved from the outside in a direction perpendicular to the rotary axis 12 of the can to press the edge portion 5*a*, in order to exactly bend the edge portion 5*a* at the precise location of base portion 7 thereof, a substantially large lifter load and compressing force acting between the lifter 3 and the chuck 2 is necessitated. Accordingly, unless a large lifter load is applied, it is difficult to ensure proper sealing by providing a large overlap dimension h of the seaming portion between the edge portion 5*a* of the lid 5 and the flange edge 4*a* of the can body 4. Therefore, in such prior art arrangement, in the case of aluminum cans it is necessary to provide a compressing force or lifter load of about 80 kg. Also, a can wall thickness of 0.12 mm or more is necessary in order to ensure that buckling of the can will not be caused by such high lifter load. Accordingly, the arrangement and structure of the roll 1 in the above-described known device involves the problem that it is impossible to contemplate a reduction of the cost of the can material by reducing the can wall thickness below the above-mentioned thickness of 0.12 mm. Moreover, sometimes fine creases will be produced along the periphery of the seam, and thus there also is the problem that such creases would project into the can body, resulting in deterioration of the sealing property.

SUMMARY OF THE INVENTION

It is therefore one object of the present invention to provide a novel method for seaming packed cans, which is free from the above-mentioned shortcomings inherent in the known prior art method.

A more specific object of the present invention is to provide a method for seaming packed cans, in which even if the lifter load is reduced compared to the known prior art method, a sufficient overlap dimension of the seam can be achieved, hence the sealing property of the seam can be ensured, and accordingly, even if the can wall thickness is reduced compared to that in the prior art, buckling of the can will not occur.

According to one feature of the present invention, there is provided a method for seaming packed cans including the steps of clamping a can body and a lid between a chuck rotated by a drive and a lifter having the same rotary axis as the chuck and adapted to drive itself or to be driven at the same speed as the chuck, rotationally driving the entire assembly while applying a compression force thereto, and thereafter pressing a groove portion of a roll from the outside to an edge portion of the lid to deform the edge portion downwardly and inwardly and then upwardly, thereby ensuring the sealing property of a seam thus formed, in which seaming is effected by pressing the groove portion of the roll to the edge portion of the lid with the rotary axis of the roll maintained inclined with respect to the rotary axis of the chuck.

According to the present invention, owing to the above-mentioned characteristic feature that seaming is effected by pressing the groove portion of the roll to the edge portion of the lid with the rotary axis of the roll maintained inclined with respect to the rotary axis of the chuck, the location of the edge portion of the lid coming into contact with the groove of the roll will change from the upper portion of a flange of the lid to its side portion and then to its lower portion as the lid and the can body rotate. Hence, wrapping deformation of the edge portion of the lid will proceed smoothly. As a result, folding deformation of the edge portion of the can body, that secondarily results from the wrapping deformation of the lid edge portion, is achieved easily. Therefore, successive seaming between the lid and the can will be achieved perfectly even with a smaller lifter load than that employed in the prior art. Accordingly, even in the case of cans having a thinner wall thickness than is possible in the prior art, seaming can be effected without generating buckling of the can. Therefore, can material costs can be reduced by an amount corresponding to the reduced can wall thickness. Furthermore, according to the present invention, creases will not be produced along the periphery of the lid at the seam, contrary to the prior art method, and a sufficiently large overlap dimension at the seam can be realized.

The above-mentioned and other objects, features and advantages of the present invention will become more apparent by reference to the following description of the preferred embodiments of the invention taken in conjunction with the accompanying drawings.

DESCRIPTION OF THE PREFERRED EMBODIMENTS

Now, the present invention will be described in greater detail with reference to the accompanying drawings, in which FIGS. 1 and 2 respectively show different preferred embodiments of the invention.

Figure 1:
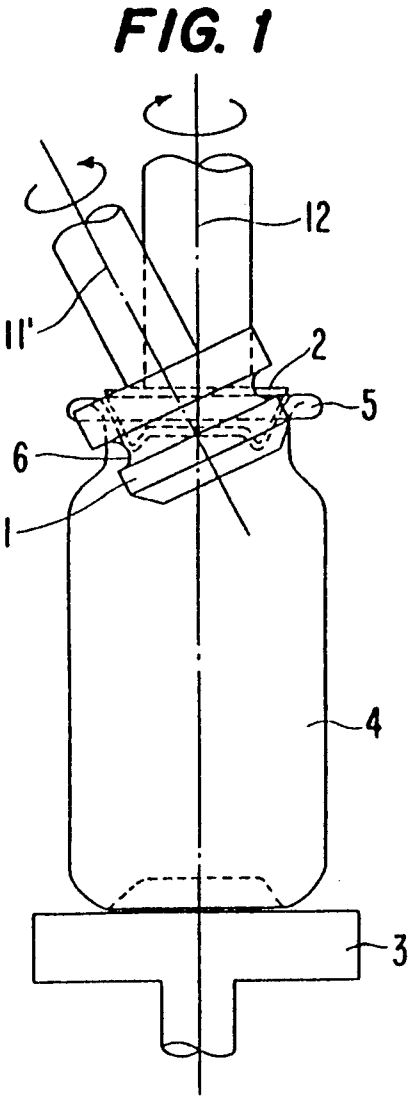
FIG. 1 is a front view showing an inclined state of a roll in a method for seaming packed cans according to a first preferred embodiment of the present invention.
Figure 3:
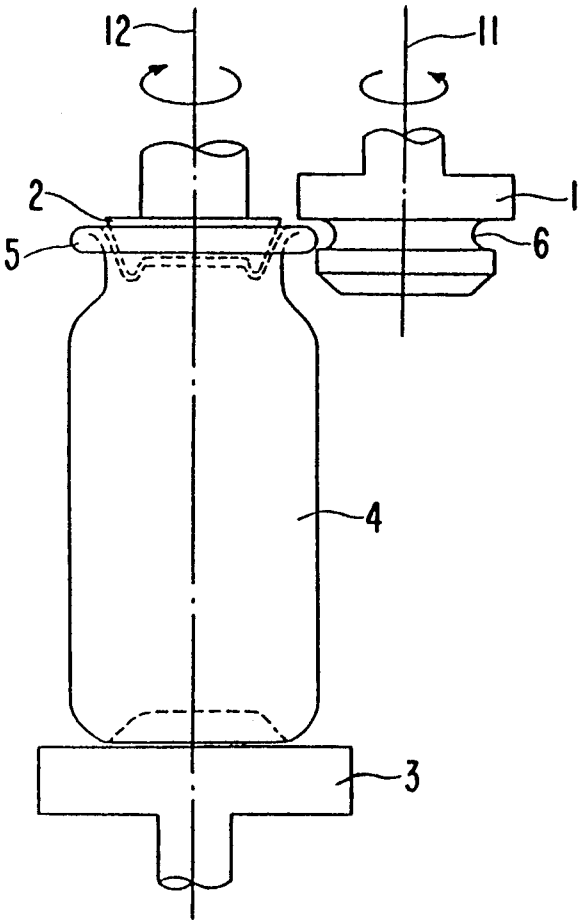
FIG. 3 (PRIOR ART)
FIG. 3 is a side view showing one example of a prior art automatic can seamer for packed cans.

At first, referring to FIG. 1, reference numeral 1 designates a roll having a groove 6, numeral 2 designates a chuck, numeral 3 designates a lifter, numeral 4 designates a can body, numeral 5 designates a lid, numeral 12 designates a rotary axis of chuck 2, and the structures of the respective members are identical to those shown in FIG. 3. The method illustrated in FIG. 1 is different from the prior art method shown in FIG. 3 in that the groove 6 of the roll 1 is pressed toward an edge portion 5*a* of the lid 5 with a rotary axis 11' of the roll 1 maintained inclined or orthogonal with respect to the rotary axis 12 of the chuck 2.

The arrangement of the roll 1 shown in FIG. 1 is such that seaming work is effected by pressing the groove 6 of the roll 1 to the edge portion 5*a* of the lid 5, with the rotary axis 11' of the roll 1 maintained inclined with respect to the rotary axis 12 of the chuck 2 and maintained in a plane that is tangential to a cylindrical surface having its center axis located at the rotary axis 12. More particularly, starting from a state where the rotary axis 11' is parallel to the rotary axis 12 with the surface of the roll 1 kept in contact with a cylindrical surface having its center axis at the rotary axis 12, the rotary axis 11' is inclined leftwards as viewed in FIG. 1 in a plane that is tangential to such cylindrical surface. It is to be noted that while the rotational direction of the rotary axis 11' of the roll 1 is that direction for causing the roll 1 to depress the lid 5 in the illustrated case, the roll 1 could be rotated in the opposite direction, in which case the roll 1 would push up the lid 5.

Figure 4:
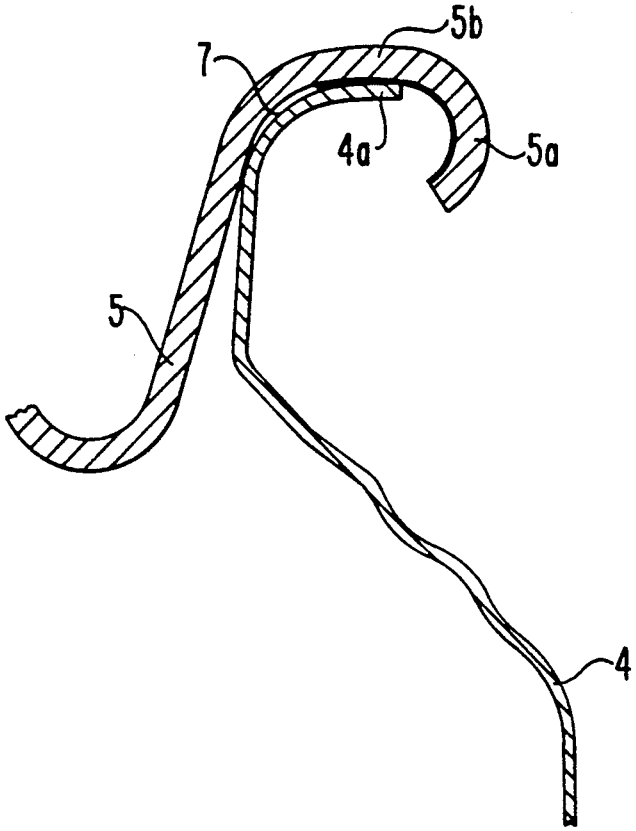
FIG. 4 (PRIOR ART)
FIGS. 4, 5 and 6 are enlarged partial cross-section views showing successive working steps for forming a seam between a can body and a lid in the prior art.
Figure 5:
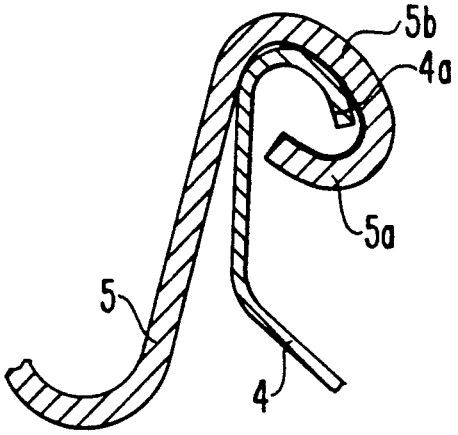
FIG. 5 (PRIOR ART)
Figure 6:
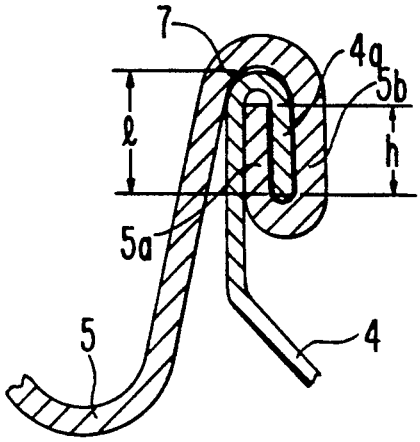
FIG. 6 (PRIOR ART)
Figure 7:
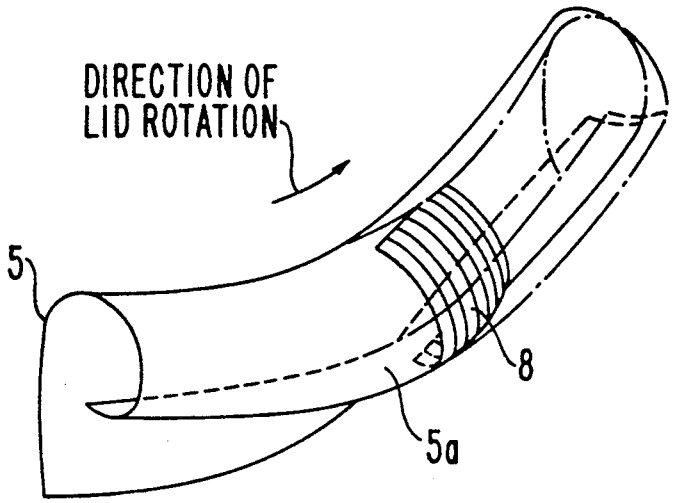
FIG. 7 (PRIOR ART)
FIG. 7 is a perspective view showing a contact location between a non-inclined roll and a lid in the prior art.
Figure 8:
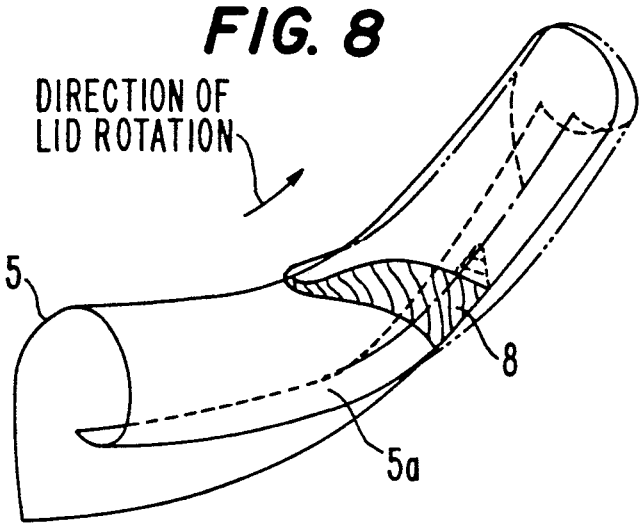
FIG. 8 is a perspective view showing a contact location between an inclined roll and a lid according to the present invention.

Now, explaining the operation of the above-described arrangement, the can body 4 and the lid 5 placed on the mouth portion of the can body are clamped between the lifter 3 and the chuck 2 with an appropriate lifter load, and when the chuck 2 is rotated about the rotary axis 12 by drive means, not shown, the chuck 2, the can body 4 and the lifter 3 rotate integrally in the same direction. On the other hand, the roll 1 successively approaches to the lid 5 while being rotated in the direction of the arrow in FIG. 1 about the roll rotary axis 11' by separate drive means, not shown, it presses the groove 6 toward the edge portion 5*a* of the lid 5, and thereby the seaming portion of the can body 4 and the lid 5 is subjected to successive working operations, starting from the state shown in FIG. 4, through the state shown in FIG. 5 into the state shown in FIG. 6. Contact locations 8 between the deforming edge portion 5*a* and the roll 1 during this seaming operation will align in radial lines as shown in FIG. 7 in the event that the rotary axis of the roll 1 is not inclined, as in the prior art. However, with such rotary axis inclined, as the seaming portion and hence the lid 5 rotationally proceed, the contact portions 8 change in orientation from the upper portion of the lid edge through its side portion to its lower portion as shown in FIG. 8. Therefore, wrapping deformation of the can lid edge portion 5*a* will proceed smoothly. Consequently, folding of the can flange portion becomes deep as a secondary result of the deformation of the can lid edge portion 5*a*, and a sufficient body hook dimension l can be realized.

Figure 2:
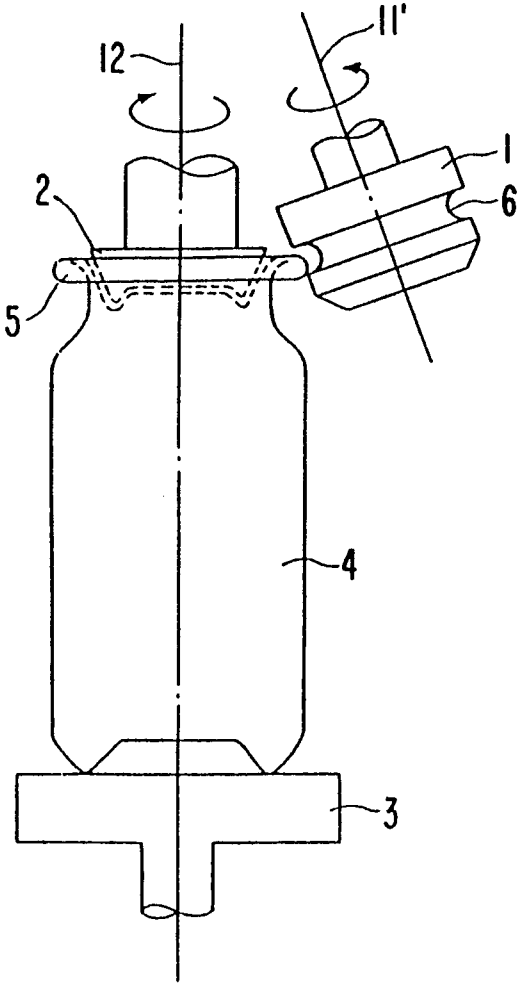
FIG. 2 is a side view showing a different inclined state of a roll in a method for seaming packed cans according to a second preferred embodiment of the present invention.

FIG. 2 shows a second preferred embodiment of the present invention, in which seaming is effected by pressing a groove 6 of a roll 1 to an edge portion 5*a* of a lid 5 with a rotary axis 11' of the roll 1 inclined with respect to a rotary axis 12 of a chuck 2 within a plane containing the rotary axis 12. More particularly, starting from the state where the rotary axis 11' is parallel to the rotary axis 12 with the surface of the roll 1 kept in contact with a circumferential surface having its center axis at the rotary axis 12, the rotary axis 11' in inclined within the plane containing the rotary axis 12 so that the upper portion of the rotary axis 11' approaches the rotary axis 12. It is to be noted that the direction of inclination of the axis 11' of the roll 1 could be opposite to the direction of inclination in the illustrated case.

Furthermore, the seaming method according to the present invention can be practiced even by pressing the groove 6 of the roll 1 to the edge portion 5*a* of the lid 5 with the rotary axis 11' of the roll 1 inclined in any arbitrary direction with respect to the rotary axis 12 of the chuck 2 in combination of the first and second preferred embodiments illustrated in FIGS. 1 and 2, respectively, and in most cases some such combined inclination is employed. It is to be noted that a possible range of the inclination angle of the rotary axis 11' with respect to the rotary axis 12 in the above-described respective embodiments, is 1°–6°, and an appropriate range thereof is 3°–4°.

Figure 9:
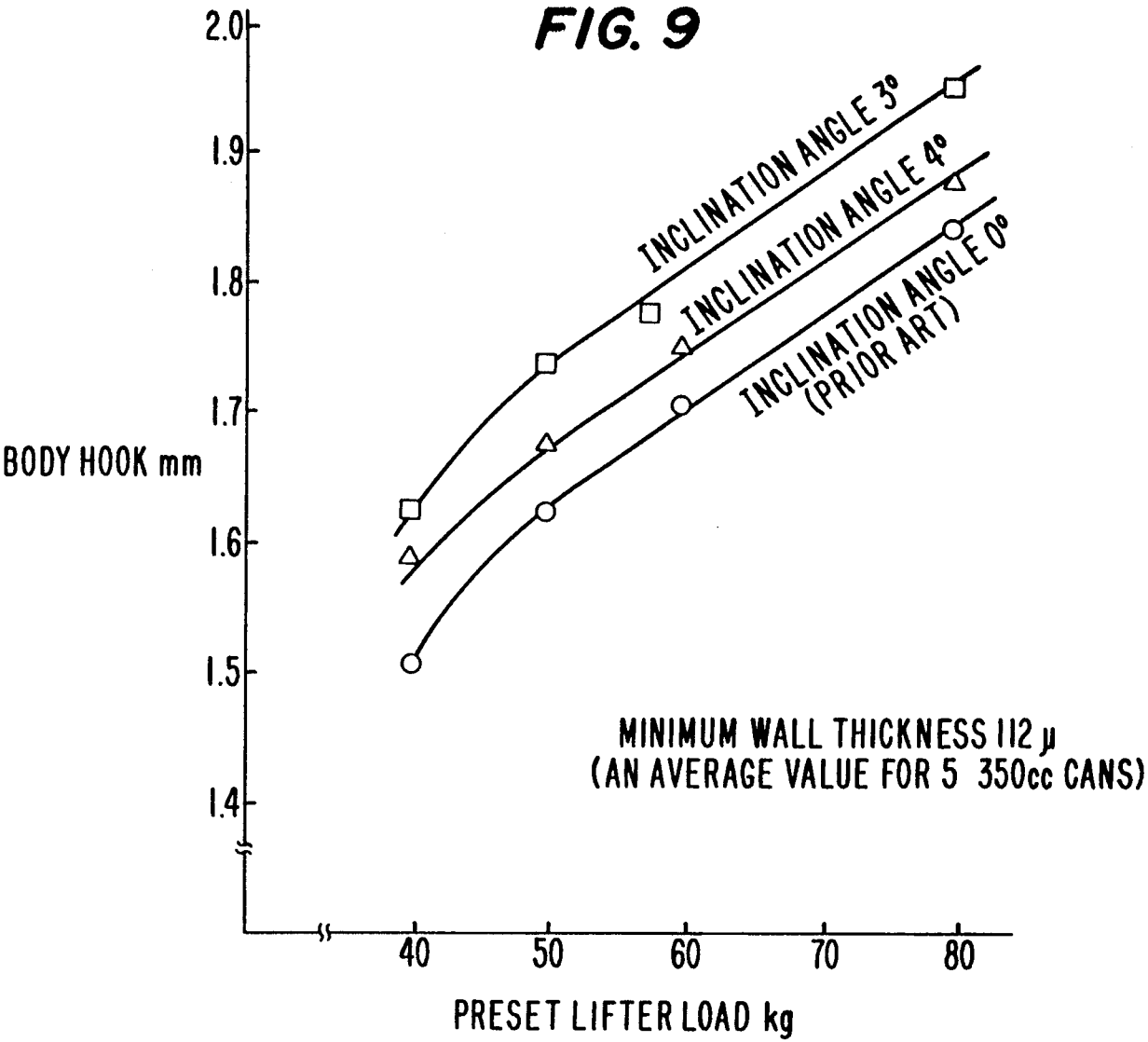
FIG. 9 is a diagram showing a relationship between a preset lifter load and a body hook dimension.

The diagram in FIG. 9 shows the correlation between a preset load of the lifter 3, shown along the abscissa, and a body hook dimension l, shown along the ordinate, in a case where the seaming roll 1 is inclined in the direction of a lever being pressed to the can body 4 in a rotary motion type can seamer that is employed in many seaming lines. An inclined roll 1 having the width of the groove 6 broadened by about 5% as compared to that in the prior art was employed, and data for a roll having an inclination angle of 3° and that having an inclination angle of 4° are shown. With regard to the direction of inclination, mainly the rotary axis 11' of the roll 1 is inclined with respect to the rotary axis 12 of the chuck 2 within a plane tangential to a cylindrical surface having its center axis aligned at the rotary axis 12, as shown in FIG. 1.

As seen from FIG. 9, a preset load for the lifter 3 that is necessary for obtaining the same body hook dimension l can be reduced by 5–15 kg as compared to the prior art method.

As explained in detail above, according to the present invention, owing to the fact that seaming is effected by pressing the groove portion of the roll to the edge portion of the lid with the rotary axis of the roll kept inclined with respect to the rotary axis of the chuck, the location of the edge portion of the lid coming into contact with the groove of the roll changes from the upper portion of the lid flange to its side portion and then to its lower portion as the lid and the can body rotate. Hence, wrapping deformation of the edge portion of the lid proceeds smoothly, whereby folding deformation of the edge portion of the can body becomes easy, and therefore, successive seaming of the can flange can be achieved perfectly even with a smaller lifter load than employed in the prior art. Accordingly, even in the case of cans having a thinner wall thickness than is possible in the prior art, seaming of a can flange can be effected without generating buckling of the can, and thus can material costs can be reduced by an amount corresponding to the reduced thickness. Furthermore, according to the present invention creases will not be produced along the periphery of the lid at the seaming portion, contrary to the prior art method, and a sufficiently large overlap dimension at the seaming portion can be realized.

While a principle of the present invention has been described above in connection with preferred embodiments of the invention, it is a matter of course that many apparently widely different embodiments of the present invention could be made without departing from the spirit of the present invention.

What is claimed is:

1. A method of seaming a can lid to a can body, said method comprising:

clamping said lid and body between a chuck rotated by drive means and a lifter having a rotary axis coincident with a rotary axis of said chuck, thus forming a clamped assembly;

rotating said clamped assembly about said coincident axes while maintaining a clamping force between said lid and body;

moving a roll having a peripheral groove from a first position spaced from the thus rotating clamped assembly in a direction perpendicular to said coincident axes to a second position pressing against an edge portion of said lid and thereby deforming said edge portion and an edge portion of said body to form a sealed seam therebetween; and maintaining said roll during said movement thereof and at both said first and second positions thereof at an orientation relative to said coincident axes wherein said rotary axis of said roll is inclined relative to said coincident axes, said maintaining comprising positioning said roll in a constant orientation such that said rotary axis thereof always is located in planes parallel to said coincident axes and tangential to cylindrical surfaces centered about said coincident axes.

* * * * *